US008784077B1

(12) United States Patent
Ray

(10) Patent No.: US 8,784,077 B1
(45) Date of Patent: Jul. 22, 2014

(54) SUBMERSIBLE BATTERY OPERATED WATER PUMP SYSTEM

(76) Inventor: Brian Ray, St. Charles, IL (US)

( * ) Notice: Subject to any disclaimer, the term of this patent is extended or adjusted under 35 U.S.C. 154(b) by 190 days.

(21) Appl. No.: 13/066,996

(22) Filed: Apr. 29, 2011

Related U.S. Application Data

(60) Provisional application No. 61/329,578, filed on Apr. 30, 2010.

(51) Int. Cl.
*F04D 25/06* (2006.01)

(52) U.S. Cl.
CPC ..... *F04D 25/0673* (2013.01); *F04D 25/0686* (2013.01)
USPC ..... 417/411; 417/423.3

(58) Field of Classification Search
CPC ..... F04D 25/0673; F04D 25/0686
USPC ..... 417/411, 423.3
See application file for complete search history.

(56) References Cited

U.S. PATENT DOCUMENTS

| | | | | |
|---|---|---|---|---|
| 4,021,150 | A * | 5/1977 | Mabuchi | 417/411 |
| 6,842,931 | B2 * | 1/2005 | Porat et al. | 15/1.7 |
| 7,241,531 | B2 * | 7/2007 | Dahlberg | 429/163 |
| 2006/0213025 | A1 * | 9/2006 | Sawalski | 15/344 |
| 2007/0116583 | A1 * | 5/2007 | Aoki | 417/437 |

* cited by examiner

*Primary Examiner* — Charles Freay
*Assistant Examiner* — Philip Stimpert
(74) *Attorney, Agent, or Firm* — Kinne IP Group, PC; Charles C Kinne; Mary E Adams

(57) ABSTRACT

The invention is a submersible battery-operated water pump system comprised of a water pump with a plug connector that attaches to a rechargeable battery via a receptacle connector for the purpose of water recirculation as used in decorative water fountains. The submersible water pump system is designed to rest at the bottom of a water reservoir (with a minimum depth of 2 inches) to recirculate water, thus producing water flow. The plug and receptacle connectors attach to distribute electrical power from the rechargeable battery to the water pump to allow operation. The submersible, rechargeable, battery-operated water pump system is cordless, thus providing safe, portable, independent operation without the use of electrical cords or outlets.

14 Claims, 2 Drawing Sheets

SUBMERSIBLE BATTERY OPERATED WATER PUMP SYSTEM

CROSS REFERENCE TO RELATED APPLICATIONS

This application claims priority to U.S. Provisional Patent Application No. 61/329,578 filed Apr. 30, 2010.

BACKGROUND OF THE INVENTION

The proposed submersible battery-operated water pump system applies to the decorative water fountain industry. The invention is a system designed to operate a water fountain by means of a cordless, water-safe submersible, rechargeable battery. Currently on the market are water fountains powered by traditional AC and DC electricity, each of which has limitations to functionality. Water fountains powered by conventional AC electricity require a power cord from the fountain to be plugged into an electrical wall outlet within close proximity, which limits accessibility and poses the risk of electrocution. Traditional DC powered fountains are cordless, however, they do not provide the voltage necessary for strong water circulation. In addition, the water pump in these models is not water submersible and will not operate if it becomes wet. The proposed invention solves these issues by combining cutting edge water pump and battery technology to comprise a water pump system that operates with enough voltage to circulate a high volume water flow, but has the advantage of cordless portability and safety.

BRIEF SUMMARY OF INVENTION

The present invention provides a cordless submersible water pump system comprised of a water pump connected through waterproof connectors to a rechargeable battery for the purpose of recirculation of water. A brushless DC water pump provides optimal energy management for the specifically designed Lithium Ion battery to maintain a total energy-efficient system. The means for connecting power from the battery to the water pump is achieved through a waterproof connection comprised of a plug connector and receptacle connector. This invention incorporates the features of existing water pump and battery technology and applies them in a new context. This invention is intended to, but not limited to converting corded water fountains to an independently operational cordless unit.

DETAILED DESCRIPTION OF THE INVENTION

Figure 1:
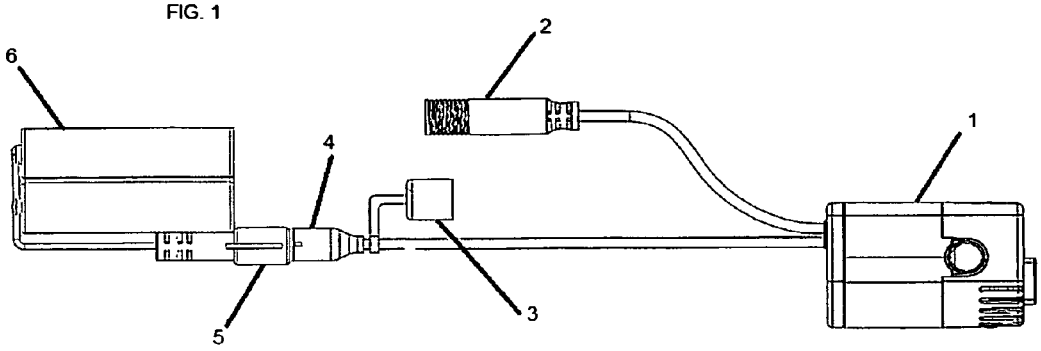
FIG. 1 is a top view of the submersible rechargeable battery operated water pump system.
Figure 1A:
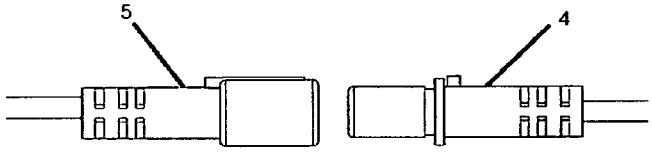
FIG. 1A is a side view of the water pump plug connector and battery receptacle connector which comprises a waterproof connection.
Figure 2:
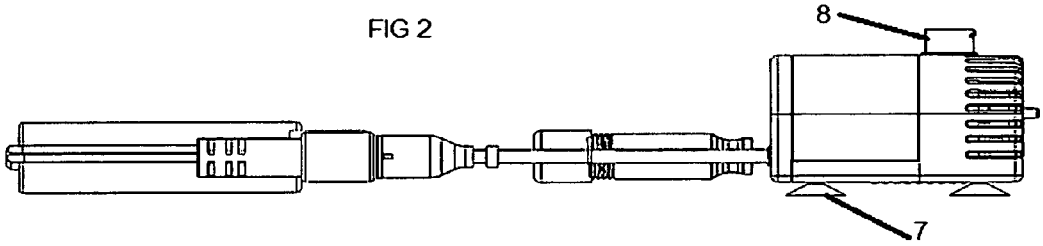
FIG. 2 is a side view of the submersible rechargeable battery operated water pump system.
Figure 3:
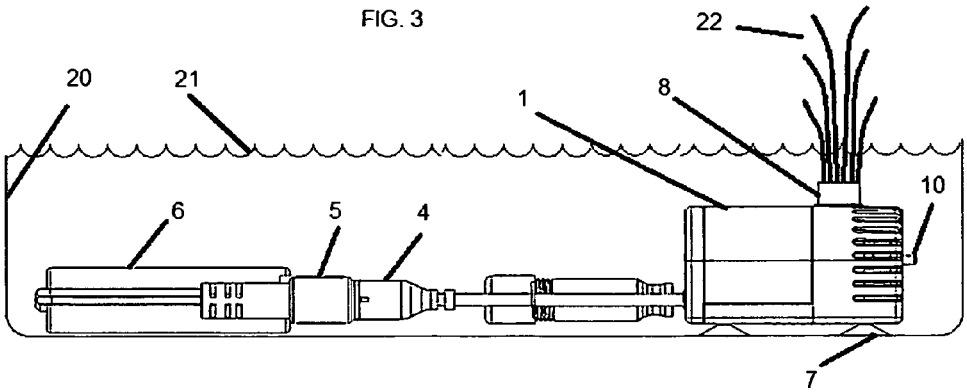
FIG. 3 is a side view of the submersible rechargeable battery operated water pump system as it is designed to be used submerged in water.

Referring to the drawings, FIG. 1 illustrates the 1 water pump, the 2 auxiliary connector, the 3 auxiliary cap, the 4 plug connector, the 5 receptacle connector, and the 6 battery. FIG. 1A illustrates a close up view of the 4 plug connector and the 5 receptacle connector before connection. FIG. 2 illustrates the 8 outlet and the 7 suction cups. FIG. 3 illustrates the submersible battery operated water pump system in operation with the 22 flow coming from the 8 outlet of the 1 water pump with the 7 suction cups holding the 1 water pump at the bottom of the 20 reservoir of 21 water.

Figure 4:
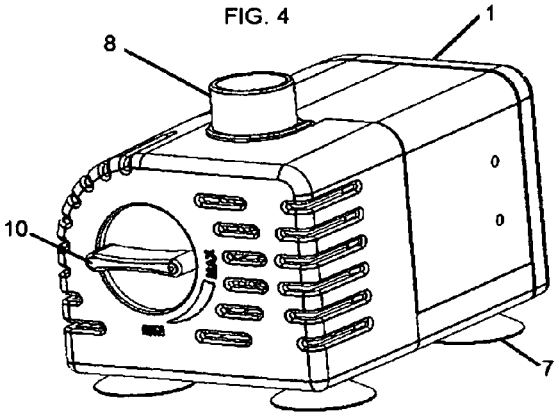
FIG. 4 is an isometric view of the water pump
Figure 5:
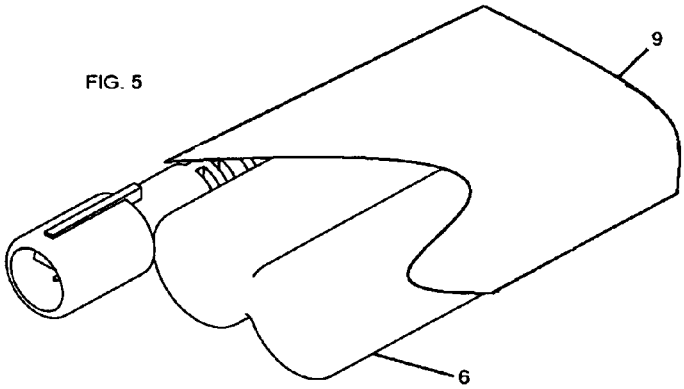
FIG. 5 is an isometric view of the rechargeable battery
Figure 6:
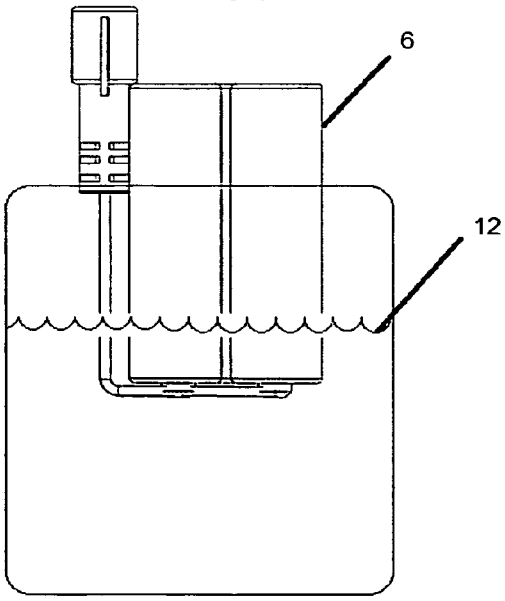
FIG. 6 is a side view of the waterproofing process of the rechargeable battery

FIG. 4 Illustrates the 1 water pump with the 8 outlet, the 10 flow dial, the 7 suction cups. FIG. 5 illustrates the 6 battery coated in the 9 synthetic rubber. FIG. 6 is a view of the 6 battery being dipped into the 12 synthetic rubber for waterproofing.

The submersible battery operated water pump system is activated as such: The 1 water pump is placed in the 20 reservoir with the 7 suction cups secured to the bottom. The 4 plug connector is inserted into the 5 receptacle connector to comprise a waterproof circuit to the 6 battery to distribute electrical power to operate the 1 water pump. Once the 1 water pump and 6 battery are connected the 22 water will flow through the 8 outlet. The flow rate can be adjusted by the 10 flow dial.

While the present invention has been proposed with specific embodiments as outlined, it is implied to those skilled in the art that modifications or various changes may be made that fall within the scope of the invention and the context of the intended claims.

What is claimed is:

1. A decorative, water fountain pump system comprising, in combination:

a water-submersible, battery-operated water pump having a vertically oriented discharge and configured to provide a flowrate of water of between 200 liters per hour and 720 liters per hour, the pump being securable to a water reservoir configured to hold a supply of water having a top surface thereon;

a waterproof plug connector electrically connected to the pump and configured to provide waterproof, electrical communication with a waterproof receptacle connector;

a waterproof, rechargeable battery substantially contained within a waterproof dip-coating;

the waterproof receptacle connector electrically connected to the battery and configured to receive the waterproof plug connector, thereby providing waterproof, electrical communication therebetween;

the pump system positioned completely within the water reservoir, thereby being completely submergible within the supply of water;

whereby the pump and the battery are electrically connected by connecting the waterproof receptacle connector and the waterproof plug connector; and whereby operating the pump in the supply of water provides the flowrate of water to the vertically oriented discharge, thereby pumping water upward and beyond the top surface of the supply of water.

2. The decorative, water fountain pump system of claim 1, wherein the battery produces a voltage of between 5.5 volts and 8.6 volts.

3. The decorative, water fountain pump system of claim 1, wherein the battery is dip-coated with a waterproof synthetic rubber.

4. The decorative, water fountain pump system of claim 1, the pump being configured to operate at a voltage of between 5.5 volts and 9 volts.

5. The decorative, water fountain pump system of claim 1, wherein the pump is a centrifugal-type pump.

6. The decorative, water fountain pump system of claim 1, the system further being configured to be portable.

7. A decorative, water fountain pump system comprising, in combination:

a water-submersible, battery-operated water pump having a vertically oriented discharge and configured to provide a flowrate of water of between 200 liters per hour and 720 liters per hour, the pump being positionable within a water reservoir configured to hold a supply of water having a top surface thereon;

a waterproof plug connector electrically connected to the pump and configured to provide waterproof, electrical communication with a waterproof receptacle connector;

a waterproof, rechargeable battery substantially contained within a waterproof dip-coating;

the waterproof receptacle connector electrically connected to the battery and configured to receive the waterproof plug connector, thereby providing waterproof, electrical communication therebetween;

the pump system positioned completely within the water reservoir, thereby being completely submergible within the supply of water;

whereby the pump and the battery are electrically connected by connecting the waterproof receptacle connector and the waterproof plug connector; and whereby operating the pump in the supply of water provides the flowrate of water to the vertically oriented discharge, thereby pumping water upward and beyond the top surface of the supply of water.

8. The decorative, water fountain pump system of claim 7, the pump further having a suction cup disposed thereon configured to be securable to a generally smooth surface provided on the water reservoir.

9. The decorative, water fountain pump system of claim 7, wherein the battery produces a voltage of between 5.5 volts and 8.6 volts.

10. The decorative, water fountain pump system of claim 7, wherein the battery is dip-coated with a waterproof synthetic rubber.

11. The decorative, water fountain pump system of claim 7, wherein the pump is configured to operate at a voltage of between 5.5 volts and 9 volts.

12. The decorative, water fountain pump system of claim 7, wherein the pump is a centrifugal-type pump.

13. The decorative, water fountain pump system of claim 7, the system further being configured to be portable.

14. A decorative, water fountain pump system comprising, in combination:

a water-submersible, battery-operated, centrifugal water pump having a vertically oriented discharge and configured to provide a flowrate of water of between 200 liters per hour and 720 liters per hour, the pump having a suction cup disposed thereon configured to be securable to a generally smooth surface provided on a water reservoir, the water reservoir configured to hold a supply of water having a top surface thereon;

the pump further being configured to operate at a voltage of between 5.5 volts and 9 volts;

a waterproof plug connector electrically connected to the pump and configured to provide waterproof, electrical communication with a waterproof receptacle connector;

a waterproof, rechargeable battery substantially contained within a waterproof, synthetic rubber dip-coating and configured to produce a voltage of between 5.5 volts and 8.6 volts;

the waterproof receptacle connector electrically connected to the battery and configured to receive the waterproof plug connector, thereby providing waterproof, electrical communication therebetween;

the pump system positioned completely within the water reservoir, thereby being completely submergible within the supply of water;

whereby the pump and the battery are electrically connected by connecting the waterproof receptacle connector and the waterproof plug connector; and whereby operating the pump in the supply of water provides the flowrate of water to the vertically oriented discharge, thereby pumping water upward and beyond the top surface of the supply of water; and wherein the system is configured to be portable.

* * * * *